US007234649B2

(12) United States Patent
Robinson

(10) Patent No.: US 7,234,649 B2
(45) **Date of Patent: *Jun. 26, 2007**

(54) SPRAY GUN

(75) Inventor: George Walter Robinson, Spalding (GB)

(73) Assignee: G. Vincent Limited, Spalding (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/219,426

(22) Filed: Sep. 2, 2005

(65) Prior Publication Data

US 2006/0043216 A1 Mar. 2, 2006

Related U.S. Application Data

(63) Continuation of application No. 10/489,628, filed on Aug. 9, 2004, now Pat. No. 7,004,404.

(51) Int. Cl.

| | |
|---|---|
| ***B67D 1/28*** | (2006.01) |
| ***B05B 1/28*** | (2006.01) |
| ***B05B 7/30*** | (2006.01) |
| ***B05B 7/06*** | (2006.01) |
| ***B05B 7/02*** | (2006.01) |

(52) U.S. Cl. ..... 239/73; 239/290; 239/353; 239/414; 239/419; 239/424; 239/526; 239/527

(58) Field of Classification Search ..... 239/73, 239/290, 353, 414, 419, 424, 526, 527, 71, 239/296, 298, 407, 413, 415, 423, 346, 528, 239/533.1, 533.5

See application file for complete search history.

(56) References Cited

U.S. PATENT DOCUMENTS

| | | | | |
|---|---|---|---|---|
| 1,490,238 A | | 4/1924 | Sullivan | |
| 1,982,055 A | * | 11/1934 | Jenkins | 239/301 |
| 2,255,189 A | | 9/1941 | Robinson et al. | |
| 2,904,262 A | * | 9/1959 | Peeps | 239/408 |
| 3,796,376 A | * | 3/1974 | Farnsteiner | 239/353 |
| 3,857,511 A | | 12/1974 | Govindan | |
| 4,154,403 A | * | 5/1979 | Forrester | 239/528 |
| 5,064,119 A | * | 11/1991 | Mellette | 239/8 |

(Continued)

FOREIGN PATENT DOCUMENTS

| | | |
|---|---|---|
| DE | 201 950 C | 5/1907 |

(Continued)

*Primary Examiner*—Kevin Shaver
*Assistant Examiner*—Darren Gorman
(74) *Attorney, Agent, or Firm*—Drinker Biddle & Reath LLP

(57) ABSTRACT

A spraying apparatus for spraying liquid surface treatment material which includes a gas inlet, a liquid inlet and an outlet nozzle. The apparatus also has a needle valve for regulating the supply of surface treatment material to the nozzle. The needle valve is at least partially located within a gas outlet chamber and is adapted so as to cause minimal disruption to the gas flow from the gas inlet to the nozzle. To further aid gas flow efficiency, the gas supply passage is substantially straight, the outlet chamber has a laterally outwardly tapering inlet and an inwardly tapering outlet and a smooth radius of curvature from the gas supply passage into the outlet chamber. There is also provided a control means for controlling the axial movement of the needle valve, the control means being provided with indicator means so as to provide an accurate, repeatable control means.

5 Claims, 8 Drawing Sheets

U.S. PATENT DOCUMENTS

| | | | | | |
|---|---|---|---|---|---|
| 5,078,323 | A * | 1/1992 | Frank | 239/296 |
| 5,080,285 | A * | 1/1992 | Toth | 239/300 |
| 5,090,623 | A * | 2/1992 | Burns et al. | 239/301 |
| 5,131,160 | A * | 7/1992 | Proell et al. | 33/519 |
| 5,190,219 | A * | 3/1993 | Copp, Jr. | 239/296 |
| 5,277,367 | A * | 1/1994 | Hsu | 239/73 |
| 5,332,159 | A * | 7/1994 | Grime et al. | 239/412 |
| 5,671,888 | A * | 9/1997 | Smith | 239/415 |
| 6,264,113 | B1 * | 7/2001 | Dingler | 239/290 |
| 6,425,533 | B1 * | 7/2002 | Shilton et al. | 239/290 |
| 6,460,787 | B1 * | 10/2002 | Hartle et al. | 239/691 |
| 6,793,157 | B1 * | 9/2004 | Lindsay et al. | 239/527 |

FOREIGN PATENT DOCUMENTS

| | | | |
|---|---|---|---|
| DE | 212 459 | C | 10/1907 |
| DE | 209 899 | C | 5/1909 |
| FR | 1 072 691 | A | 9/1954 |
| FR | 2 485 954 | A | 1/1982 |

* cited by examiner

SPRAY GUN

RELATED APPLICATIONS

This is a continuation of application Ser. No. 10/489,628, filed Aug. 9, 2004 now U.S. Pat. No. 7,004,404.

FIELD OF THE INVENTION

The present invention relates to an apparatus to improve efficiency in the spraying of materials. Particularly, but not exclusively, the invention is a spray gun for the application of paint and similar material surface treatments, particularly water-based paints.

BACKGROUND OF THE INVENTION

Various known spray guns have been developed for the purpose of reducing pressure losses between the air inlet and air outlet of guns. Conventional spray guns, high volume-low pressure (HVLP) guns and low volume-low pressure (LVLP) guns all suffer from a reduction in air pressure through the gun. In some instances, this reduction can be over 80%.

HVLP guns require very large volumes of air to maintain an acceptable atomization of the spray material. For example, to pass large volumes of air through an HVLP gun requires very high pressures to maintain a 10 psi (0.69 bar) pressure in the head of the gun, resulting in an average air consumption rate of approximately 20 scfm (566 l/min). With an input pressure of 75 psi (5.1 bar), the air expands on leaving the gun to regain its pre-compression volume. This will result in the atomized spray material being taken in all directions by the expanding air, in spite of the exit pressure being only 10 psi (0.69 bar). Thus, the spray output of HVLP guns can prove difficult to control.

Despite having a smaller clearance between the fluid tip and air cap than in HVLP guns, LVLP guns also suffer from pressure loss within the gun body. As a result, LVLP guns still require a high inlet pressure of 50–60 psi (3.45–4.14 bar) to operate at an atomizing (outlet) pressure of 15–18 psi (1.03–1.24 bar). Air consumption rates of LVLP guns range from 14–18 scfm (396–510 l/min), thus illustrating that LVLP guns are almost as inefficient as HVLP guns.

The main cause of the aforementioned inefficiency of HVLP and LVLP guns is the arrangement of the air passages within the gun body. The design and layout of air passages in the known guns leads to poor internal air flow efficiency.

It is therefore the aim of the present invention to provide a spraying apparatus which has a significantly improved air flow efficiency over known spray guns.

BRIEF SUMMARY OF THE INVENTION

According to a first aspect of the present invention, there is provided an apparatus for spraying liquid surface treatment material, the apparatus comprising:

a liquid inlet for supply of the liquid surface treatment material;

a gas inlet for supply of pressurized gas to be mixed with the liquid surface treatment material;

an outlet nozzle through which the gas and liquid surface treatment is sprayed;

a control needle valve arranged for axial movement on a first axis and adapted to regulate the supply of the liquid surface treatment material to the outlet nozzle;

a gas valve operable between an open position and a closed position;

a gas chamber communicating with said outlet nozzle and arranged to co-axially surround the control needle valve; and a gas supply passageway having first and second portions with first and second diameters, respectively, the first portion connecting said gas inlet and said gas valve and the second portion connecting said gas valve and said gas chamber;

wherein the first and second portions of the gas supply passageway are coaxial and the first and second diameters are substantially equal such that the gas supply passageway has substantially the same diameter over its entire length.

Preferably, the gas chamber has a first end portion adjacent the gas supply passageway, the first end portion having a radius of curvature so as to provide gas to the nozzle in a direction substantially parallel to said first axis, and wherein said apparatus is adapted to provide a smooth flow path for the gas therethrough. The radius of curvature is such that the minimum radius of the internal surface of the first end portion of the gas chamber is 1.3 times the diameter of the gas supply passageway.

Preferably, the gas chamber has an inner surface which tapers laterally outwardly from the first end portion of the gas chamber, the taper running in the direction of said outlet nozzle.

Preferably, the gas chamber includes a second end portion adjacent said outlet nozzle, the inner surface of said second end portion inwardly tapering towards said nozzle to provide a smooth flow path for gas flowing from the outlet chamber to the nozzle.

Preferably, said gas valve is located within said gas supply passageway. Preferably, said gas valve is an axially-sliding piston valve having an aperture therein whose diameter is substantially equal to the diameter of the gas supply passageway.

Preferably, said apparatus further comprises a trigger means adapted to operate both said control valve and said gas valve.

Preferably, said control needle valve is partially located within said gas chamber and includes a fluid tube having a fluid tube diameter and a fluid tip having a fluid tip diameter substantially equal to or less than the fluid tube diameter. Preferably, said fluid tube has a tapered throat portion located in said gas chamber, the throat portion having a throat portion diameter which is less than the fluid tube diameter.

According to a second aspect of the present invention, there is provided an apparatus for spraying liquid surface treatment material, the apparatus comprising:

a housing;

a liquid inlet for supply of the liquid surface treatment material;

a gas inlet for supply of pressurized gas to be mixed with the liquid surface treatment material;

an outlet nozzle through which the gas and liquid surface treatment is sprayed;

a control needle valve adapted to regulate the supply of the liquid surface treatment material to the outlet nozzle;

a gas supply passageway connecting said gas inlet to said outlet nozzle; and a control means for controlling the control needle valve, the control means comprising a cap member received on said housing and engaged with said control needle valve, the cap member being adapted so as to be adjustable in the axial direction relative to the housing to limit axial movement of the control needle valve.

Preferably, said cap member and housing are provided with calibrations which indicate the amount of axial adjustment of the needle valve.

Preferably, the apparatus further comprises a gas valve operable between an open position and a closed position.

In a preferred embodiment, the gas valve is located in the gas supply passageway and the apparatus further comprises a trigger means adapted to operate both said control needle valve and gas valve.

In an alternative preferred embodiment, said control needle valve and gas valve are remotely operated. Most preferably, the control needle valve is remotely operated by way of pressurised gas and the apparatus further comprises a piston chamber and piston located in the piston chamber, the piston adapted to engage said needle control valve when actuated by said pressurised gas. The apparatus also comprises a bore connecting the gas supply passageway and the piston chamber, such that pressurised gas may pass through the bore to the piston chamber when the gas valve is in the open position.

Embodiments of the present invention will now be described, by way of example only, with reference to the accompanying drawings, in which:

BRIEF DESCRIPTION OF THE DRAWINGS

FIG. 8(*b*) shows a longitudinal cross-section through the fifth embodiment shown in FIG. 8(*a*).

DETAILED DESCRIPTION OF THE DRAWINGS

Figure 1:
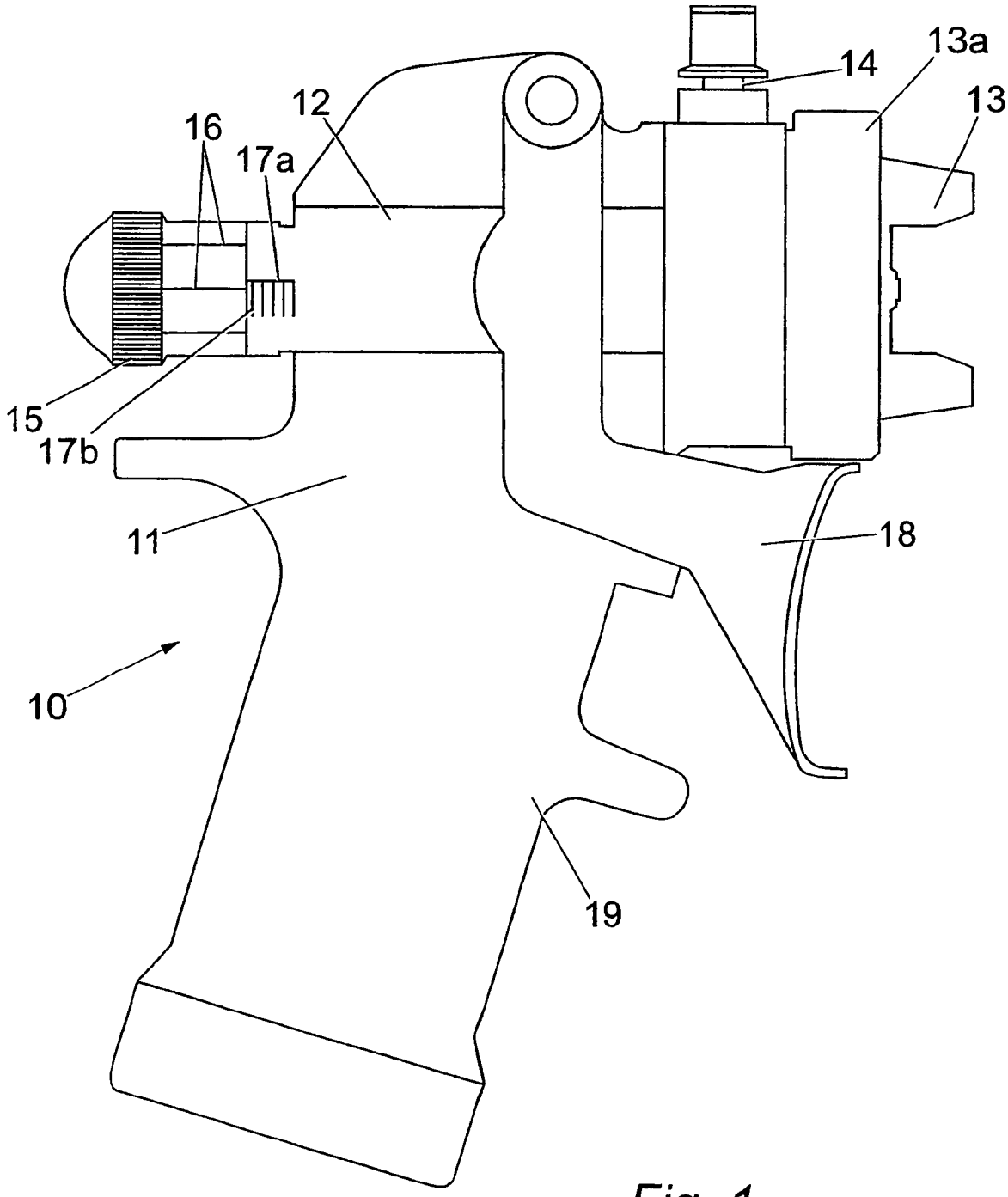
FIG. 1 shows a side elevation view of a first embodiment of a spray apparatus.

Referring initially to FIG. 1, there is shown a first embodiment of a spraying apparatus, or spray gun, generally designated 10. The spray gun 10 includes a housing 11 having a fluid control sleeve 12 slidingly attached thereto, an air cap 13 which is held on the housing 11 by an air cap ring 13*a* threadedly received on the housing 11, and a regulating valve 14 for controlling the spray pattern of the gun. Also included on the housing 11 is a needle valve cap, or fluid control nut, 15 which is attached to an internal needle valve arrangement and is threadedly received on the control sleeve 12 to limit longitudinal adjustment of the needle valve. The needle valve cap 15 is provided with horizontal markings 16 spaced equidistantly about the circumference thereof which, in combination with vertical markings on the housing 11, allow the operator to limit the movement of the needle valve and thus the amount of spray material passing through the nozzle. The housing has a horizontal indicator line 17*a* from which extend a plurality of vertical indicator lines 17*b* at 1 mm intervals. By adjustment of the cap 15, the leading edge of the cap 15 can be adjusted to line up with any of the vertical indicator lines 17*b* on the housing. In this embodiment, there are ten horizontal markings 16 on the cap 15 at equidistant intervals. Adjustment of the cap 15 can be made such that one of the horizontal markings 16 of the cap 15 can line up with the horizontal indicator line 17*a* of the housing. Thus, if one horizontal marking 16 of the cap is aligned with the horizontal line 17*a* of the housing, a 36 degree rotation of the cap will line up the subsequent horizontal marking of the cap 15. This procedure will be explained in more detail below.

The embodiment shown in FIG. 1 is a manual spray gun having a handle or grip portion 19. The gun 10 has a trigger 18 that operates a gas control valve (not shown in FIG. 1) and also acts upon the fluid control sleeve 12, such that fluid and gas are introduced to the gun simultaneously.

The operation of the first embodiment of the spray gun 10 will now be described with reference to FIG. 2. Gas is provided to the gun 10 by way of a gas inlet 20 and is then passed through a straight communicating passageway 21 to the gas control valve 23 and on to a gas chamber 26. The communicating passageway 21 has a first portion which connects the gas inlet 20 and the gas control valve 23, and a second portion which connects the gas control valve 23 to the gas chamber 26. Both portions of the passageway 21 are arranged co-axially such that the entire passageway is substantially straight. In addition, the diameters of the first and second portions are substantially the same such that there is no narrowing or widening of the passageway until it meets the gas chamber 26.

The gas control valve 23 is positioned perpendicular to the gas flow and comprises an axially-sliding piston 24 which is acted upon by the trigger 18. The piston 24 is provided with a bore 25 drilled through the piston 24 perpendicular to the longitudinal axis of the piston 24. The bore 25 is the same size as the bore of the communicating passageway 21, so that when the trigger 18 is depressed, the bore 25 aligns with the passageway 21 to provide a smooth passage for the gas through the gas control valve 23 without creating turbulence.

Once through the gas control valve 23 and the second portion of the passageway 21, the gas reaches the gas chamber 26. The gas chamber 26 has a first end portion 29 adjacent the gas passageway 21 which has a radius of curvature sufficient to direct the gas flow into a substantially horizontal direction when viewed in the accompanying figures. Preferably, the inside curve 36 of the first end portion 29 has a radius of curvature which is at least 1.3 times the diameter of the passageway 21.

As will be described below, the chamber 26 is also laterally tapered to aid gas flow therethrough. At a second end portion of the chamber 26 which is remote from the first end portion 29 is an outlet nozzle 30 through which the combined gas and spray material will exit the gun. The second end portion of the chamber 26 has an inner surface 31 which has a radius of curvature which allows the inner surface 31 to taper inwardly to the point where it reaches the output nozzle 30.

Partially located within the output chamber 26 is a control needle valve, generally designated 40. The control needle valve 40 comprises a fluid needle 43, fluid tube 44 and fluid tip 45. The cap 15 is provided with a needle housing 41 in which the fluid needle 43 is housed. The fluid needle 43 is biased by a needle spring 46 in a closed position. The needle housing 41 enters into a return spring piston 42 fitted to the control sleeve 12 by a retaining means such as a circlip, for example. A return spring 47 is also provided to bias the fluid sleeve 12 and trigger 18 in the closed position.

The fluid needle 43 extends forward through the fluid tube 44 to rest in a seat of the fluid tip 45. The needle spring 46 biases the fluid needle 43 such that it sits in the seat at the fluid tip 45, thereby blocking the exit of fluid from the fluid tube 44 to the output nozzle 30. The diameter of the fluid tip 45 is sized so as to be no greater than the diameter of the fluid tube 44, to prevent disruption to the gas flow through the output chamber 26 to the nozzle 30. Furthermore, the embodiment of FIG. 2 shows the use of a fluid tube 44 which has a narrower throat portion 44*a* within the output chamber 26. The throat portion 44*a* has a diameter less than that of the remainder of the fluid tube 44 and can be provided so as to provide a smoother passage for the gas as passes through the gas chamber 26.

In operation, the trigger 18 may always move the control sleeve 12 its full stroke. However, the cap 15 can be rotationally adjusted on the sleeve 12 to restrict or increase the intrusion of the needle housing 41 into the return spring piston 42. In this way, the movement of the fluid needle 43 can be adjusted relative to the full stroke of the sleeve 12. Where the cap 15 has been adjusted to restrict movement of the fluid needle 43 entirely, a gap exists between the end of the needle housing 41 and the end of the fluid needle 43 which is equal to the full stroke of the control sleeve 12. Thus, the trigger 18 can be operated and move the sleeve 12 to its full stroke without moving the fluid needle 43 away from its seat in the fluid tip 45.

As previously described with reference to FIG. 1, the gun housing has a plurality of vertical indicator lines 17*b* along a portion of its length at 1 mm intervals. The cap 15 can be adjusted such that the leading edge of the cap member 15 is aligned with one of the vertical indicator lines 17*b*. Once aligned, the horizontal markings 16 of the cap 15 can be aligned with the horizontal indicator line 17*a* of the housing. Each horizontal marking 16 on the cap 15 represents a reduction or increase in potential fluid needle movement of 0.1 mm. In this way, the spray gun is provided with an accurate, repeatable adjustment of the fluid needle 43 in a similar manner to that of a micrometer.

If cleaning of the fluid needle 43 is required, the cap 15 can simply be unscrewed from the gun housing and detached along with the fluid needle 43.

Figure 2:
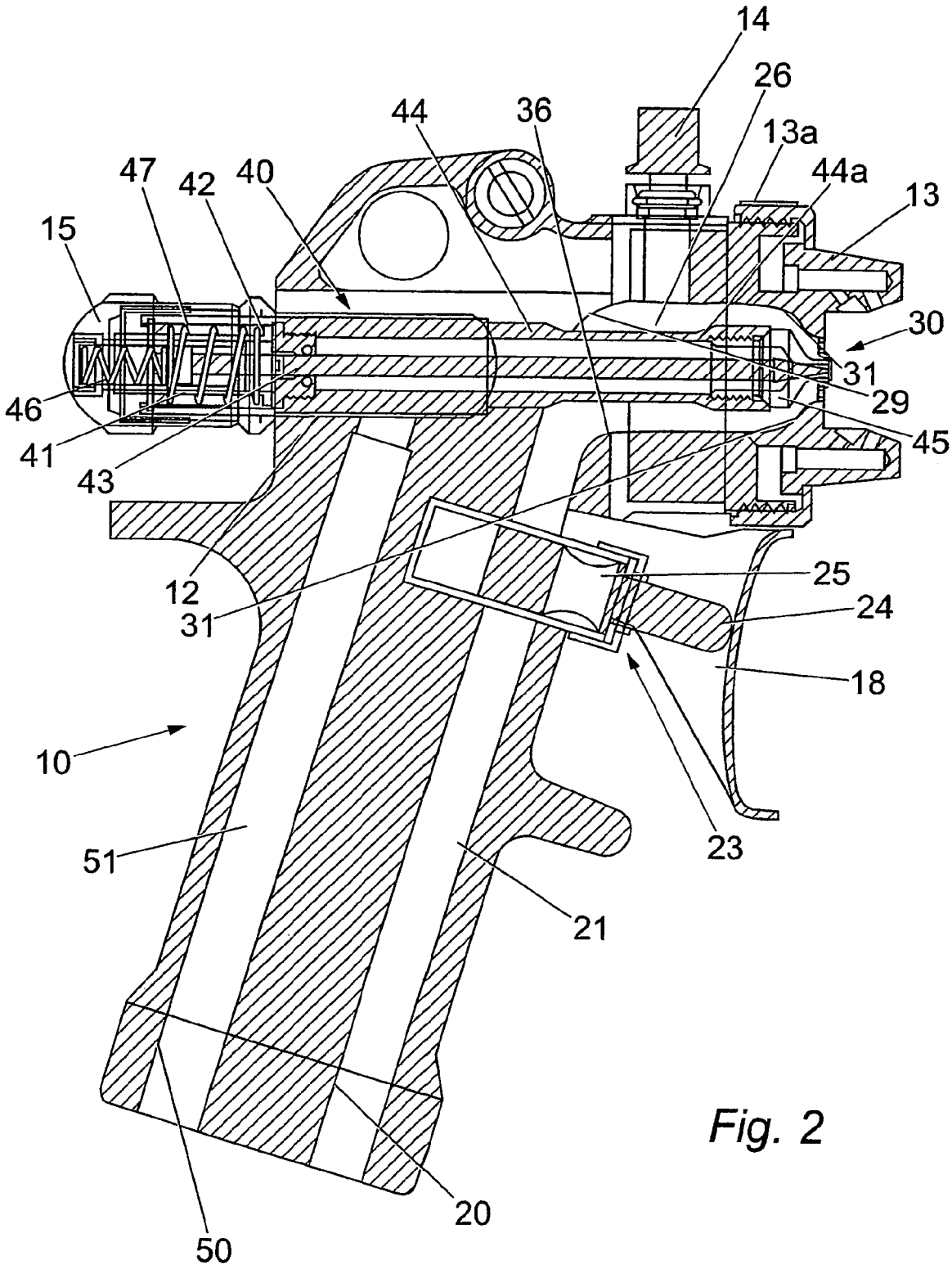
FIG. 2 shows a longitudinal cross-section of the first embodiment of the spray apparatus shown in FIG. 1.

The embodiment shown in FIGS. 1 and 2 is of a manual spray gun in which the spray material is fed in under pressure via a fluid inlet 50. A fluid passage 51 then conveys the spray material through the handle portion 19 of the gun to the fluid tube 44.

Figure 3:
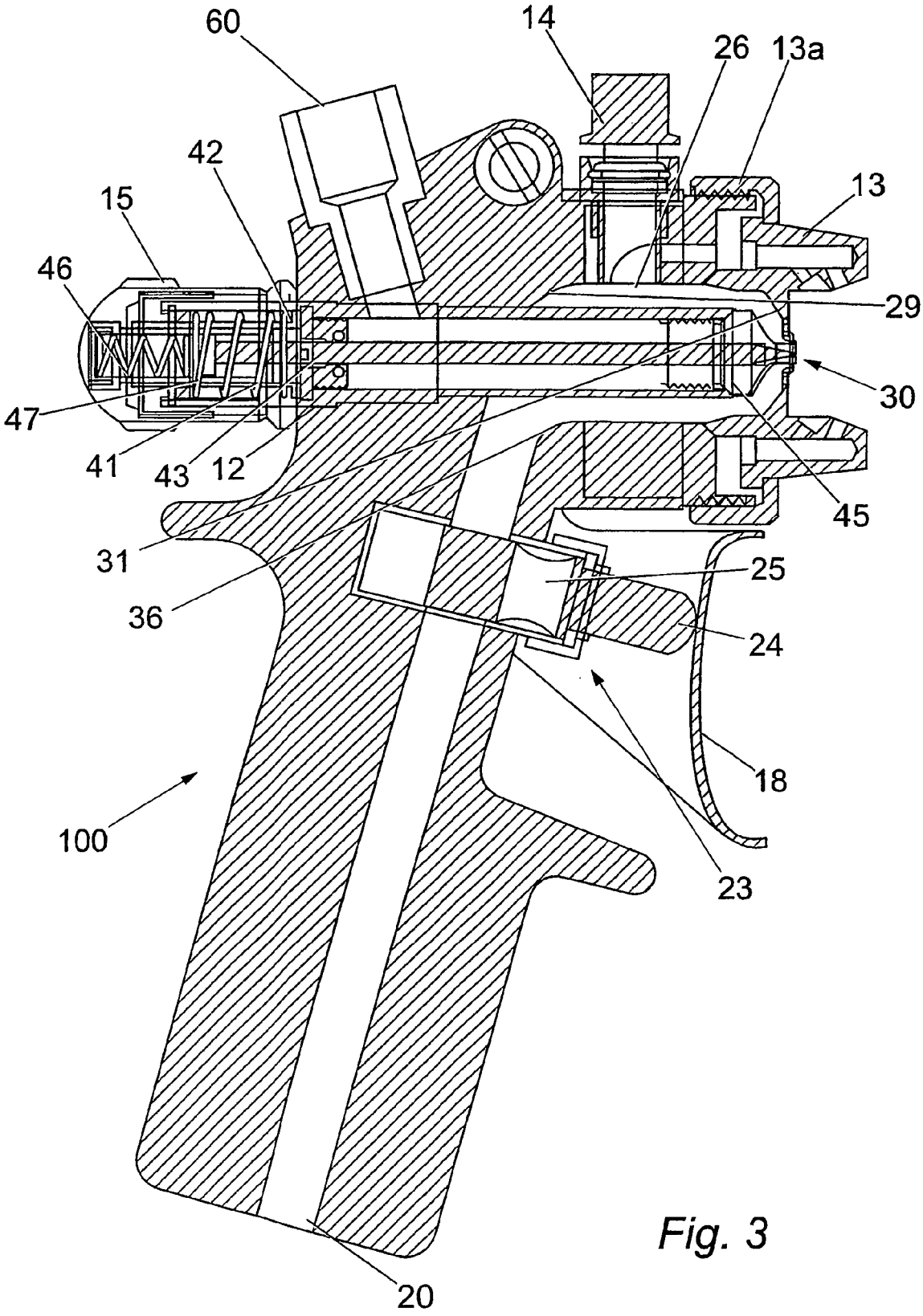
FIG. 3 shows a longitudinal cross-section of a second embodiment of the spray apparatus.

The embodiment shown in FIG. 3 is also a manual spray gun 100 and it operates in the same manner as the embodiment of FIGS. 1 and 2. Thus, the same reference signs are used for the shared components and will not be described further here. However, where this second embodiment 100 differs from the first embodiment is that the fluid is fed into the gun from a reservoir under gravity. Thus, fluid inlet 60 is located on the top of the gun 100 in this embodiment, and the fluid reservoir (not shown) may be simply screwed into the inlet 60. The fluid is then passed directly into the fluid tube 44 of the gun for delivery to the fluid tip 45 and nozzle 30.

Figure 4:
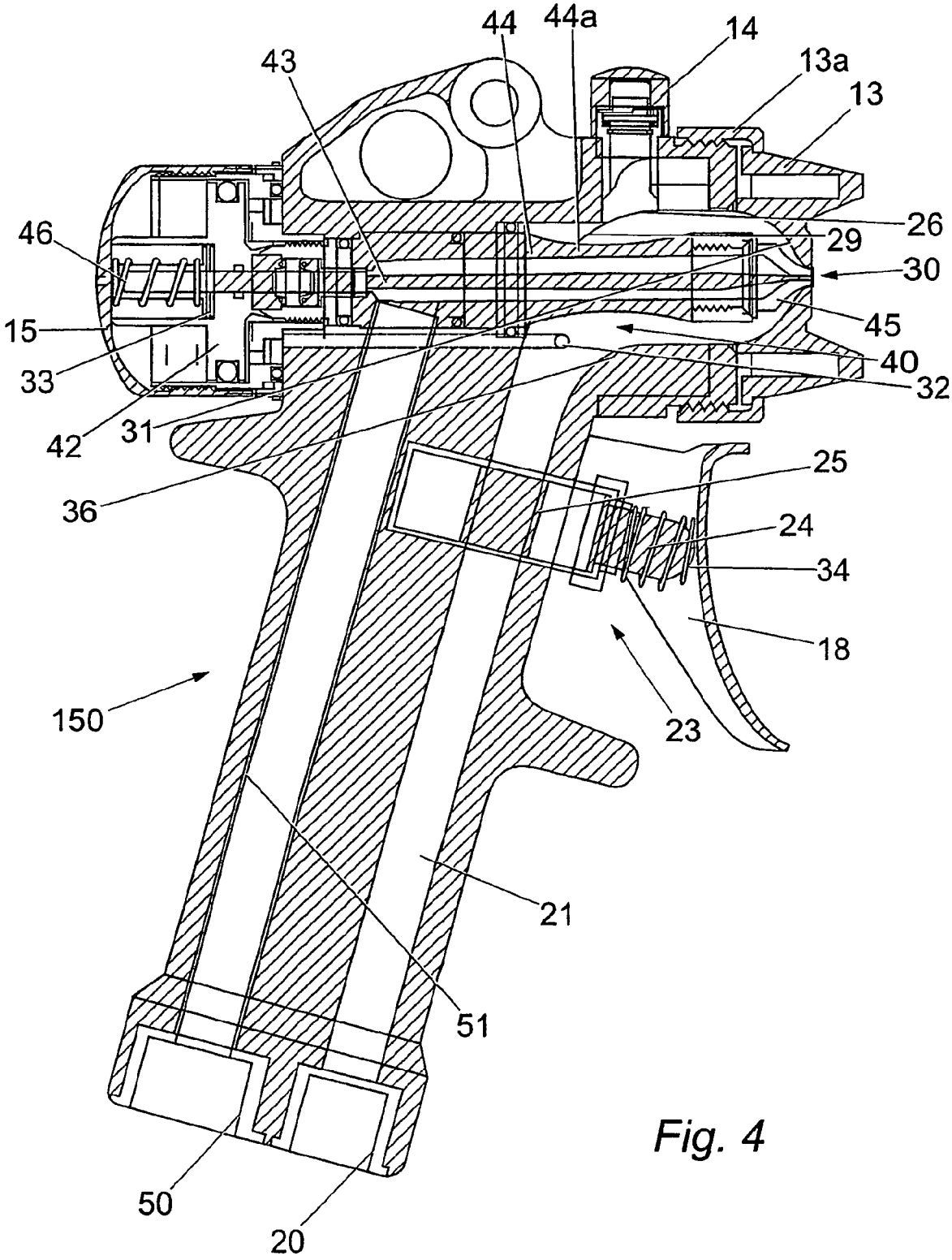
FIG. 4 shows a longitudinal cross-section of a third embodiment of the spray apparatus.

FIG. 4 shows a longitudinal cross-section through a third embodiment 150 of the spray apparatus, which is a further modification of the first embodiment of the apparatus shown in FIGS. 1 and 2. As with the second embodiment 100, the third embodiment of the gun 150 has many of the features of the first embodiment 10. Those shared features have the same reference numerals in FIG. 4 and will not be described further. However, where the third embodiment 150 differs from both the first and second embodiments 10,100 is that the gun uses pneumatic rather than mechanical operation of the needle valve. As a result, the third embodiment 150 does not have a sliding fluid control sleeve on the housing. Instead, the inlet to the chamber 26 is provided with a bore 32 which directs a portion of the pressurised gas in the passageway 21 to act directly upon the piston 42. The needle 43 is adapted with a flange 33 which is located between the needle spring 46 and the piston 42. Thus, as the pressurised gas in the bore 32 acts upon the piston 42, the piston 42 in turn acts upon the needle flange 33, moving the needle 43 away from the seat of the fluid tip 45. As gas is now acting upon the piston 42 directly, O-ring seals are added to the piston 42 itself and at the base of the end cap 15 so that there is no loss of pressurised gas during operation.

The purpose of the third embodiment 150 of the gun is to provide a manual spray gun where the fluid needle is operated without the need for a mechanical action. Once the trigger 18 is pulled and the piston bore 25 aligns with the passageway 21 to allow gas into the chamber 26, gas will enter the bore 32 and act upon the piston 42. However, the end cap 15 operates as previously described to limit the movement of the needle 43 and hence control the amount of fluid released at the nozzle 30. Once the trigger 18 is released, a trigger return spring 34 returns the trigger 18 and thus closes the passageway 21. With the gas to the piston 42 cut off, the piston 42 and needle 43 return to the closed position under the action of the return spring 46.

Figure 5A:
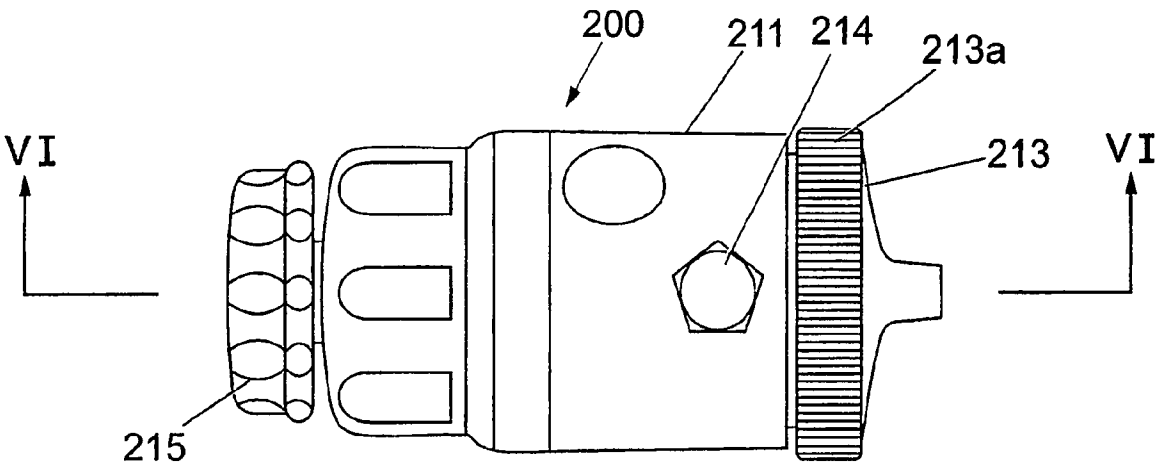
FIGS. 5(*a*) and 5(*b*) show plan and side elevation views, respectively, of a fourth embodiment of the spray apparatus.
Figure 5B:
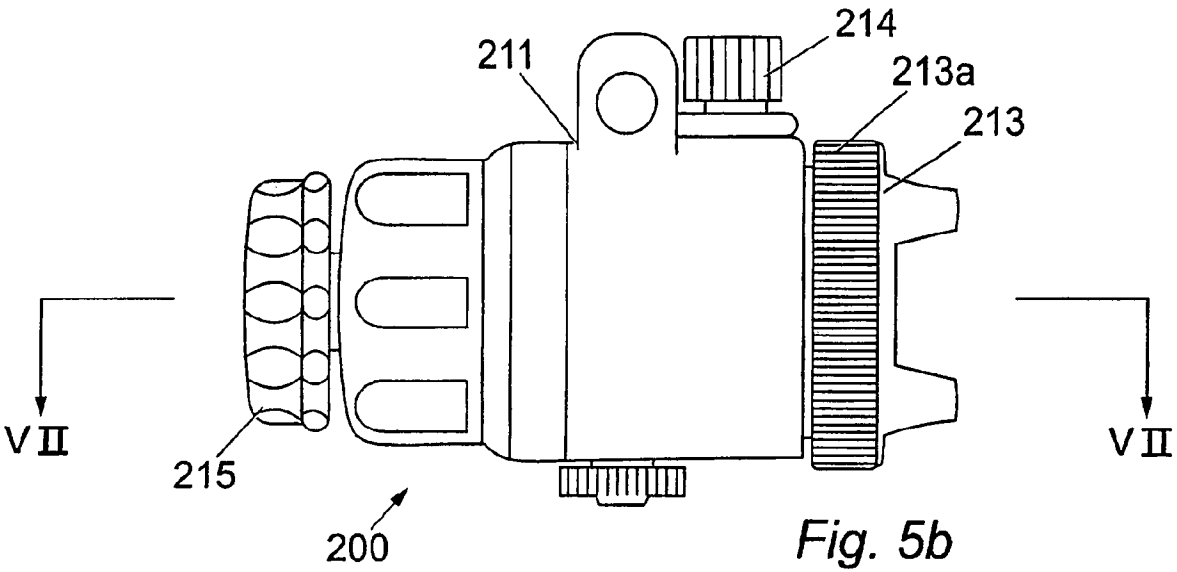

FIGS. 5(*a*) and 5(*b*) show plan and side elevation views, respectively, of a fourth embodiment of the present invention. The fourth embodiment differs from the previously described embodiments in that it is an automatic spray gun rather than a manual gun. The automatic gun, generally designated 200, shares a number of components with the previous embodiments. The gun comprises a housing 211 upon which an air cap 213 is held by an air cap ring 213*a* which is threadedly received on the housing 211. In addition, a regulating valve 214 is provided for controlling the spray pattern of the gun 200, and a needle valve cap 215 is also provided in order to limit the longitudinal adjustment of the fluid needle of a needle valve, as described in respect of the first and second embodiments.

Figure 6:
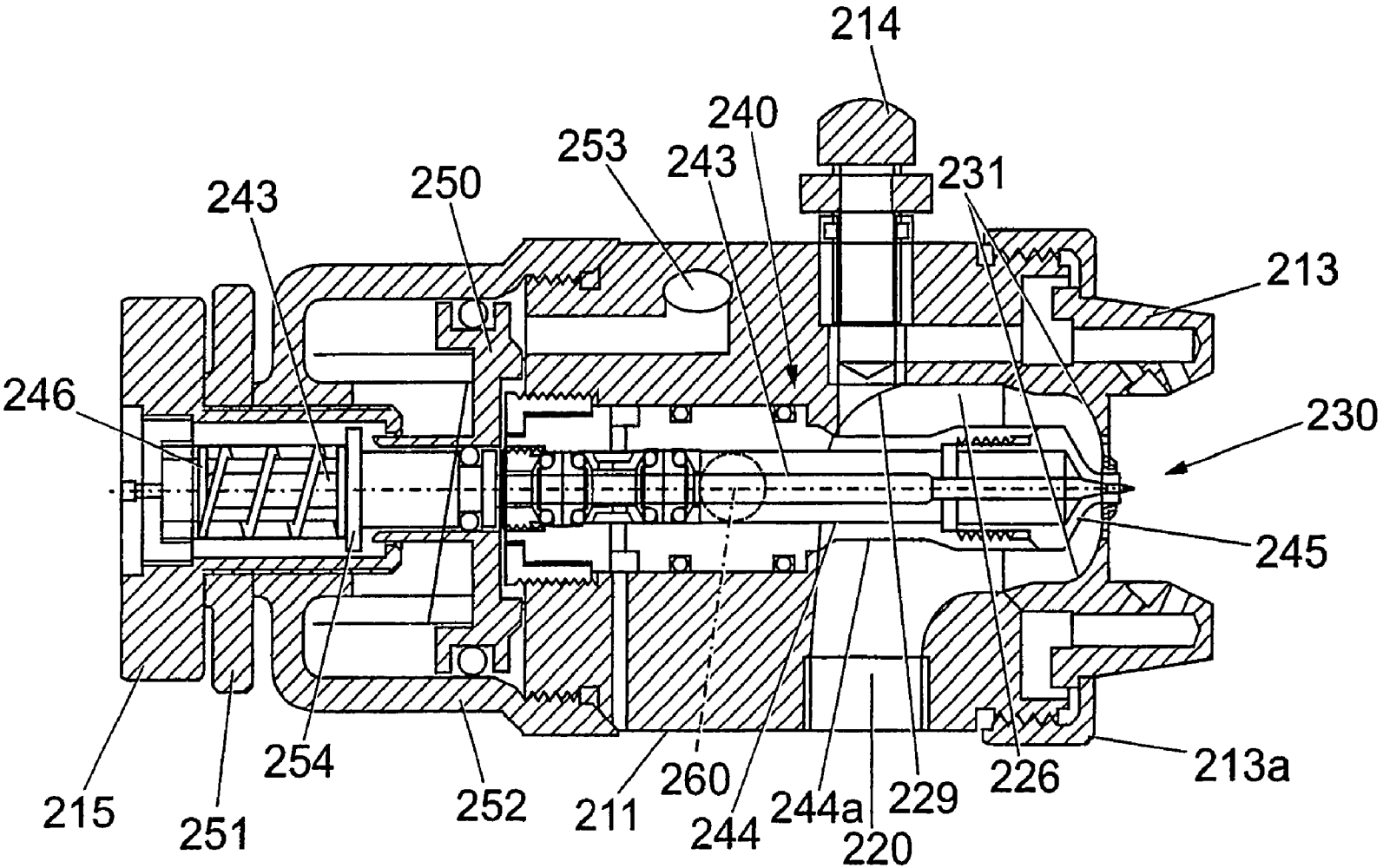
FIG. 6 shows a cross-section through the fourth embodiment of the spray apparatus, taken along line VI—VI of FIG. 5(*a*)
Figure 7:
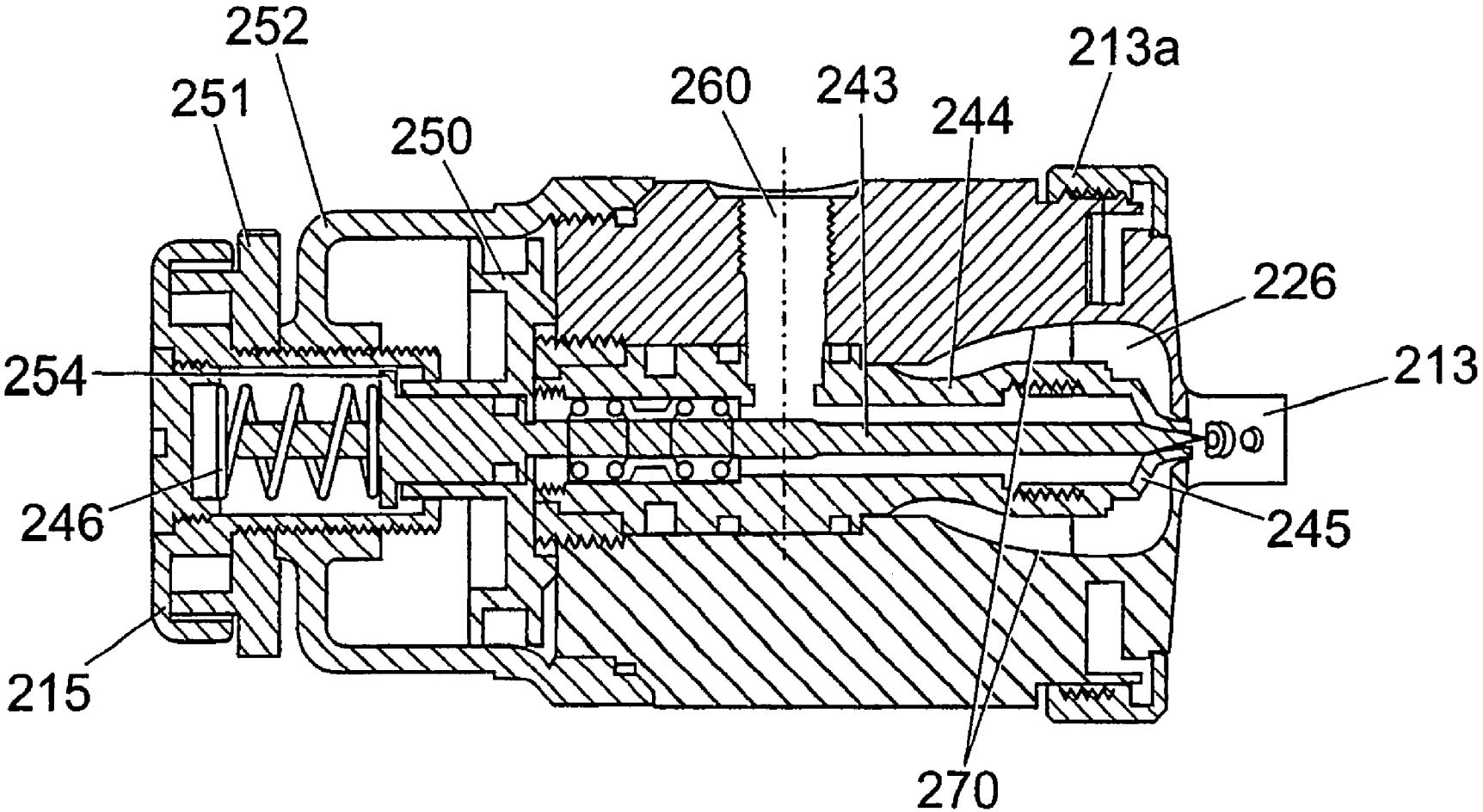
FIG. 7 shows a cross-section through the fourth embodiment of the spray apparatus, taken along line VII—VII of FIG. 5(*b*)

Turning now to FIGS. 6 and 7, the operation of the automatic gun 200 will be described in more detail. Generally, the atomising gas passes through the gun in the same manner as with the previous embodiments, except that the gas in this instance is supplied by a remote operated valve (not shown), rather than a trigger-operated valve. The gas enters the gun 200 at atomising gas inlet 220 and enters output chamber 226.

The chamber 226 has a radius of curvature 229 at its inlet end so that the incoming atomising gas is directed in a horizontal direction through the output chamber 226 towards the output nozzle 230. Furthermore, the portion of the chamber 226 adjacent the nozzle 230 has an inner surface 231 which has a radius of curvature which allows the inner surface 231 to taper inwardly to the point where it reaches the output nozzle 230.

Partially located within the output chamber 226 is a control needle valve, generally designated 240. The control needle valve 240 comprises a fluid tube 244 and a fluid tip 245, where a fluid needle 243 extends forward through the fluid tube 244 to rest in a seat of the fluid tip 245. A needle spring 246 biases the fluid needle 243 such that it sits in the seat at the fluid tip 245, thereby blocking the exit of fluid from the fluid tube 244 to the output nozzle 230. The diameter of the fluid tip 245 is sized so as to be no greater than the diameter of the fluid tube 244, to prevent disruption to the gas flow through the output chamber 226 to the nozzle 230. This embodiment again shows the use of a fluid tube 244 which has a narrower throat portion 244*a* within the output chamber 226. The throat portion 244*a* can be provided so as to provide a smoother passage for the gas as it leaves the gas inlet 220 and enters the chamber 226.

As this embodiment of the invention is an automatic gun, the trigger, control sleeve, needle housing and return spring piston necessary in the manual gun are replaced by an operating piston 250 which is housed within a piston housing 252 threadedly attached to the main housing 211 of the gun. The cap 215 operates in the same manner as described above for the previous embodiments so as to restrict the movement of the fluid needle 243 to regulate fluid flow. The markings and indicator lines described in respect of the first and second embodiments may also be used in respect of the automatic gun so that the micrometer-style adjustment of the spray may be achieved. The only difference is that the indicator lines are provided on a lock nut 251 which prevents accidental adjustment of the cap 215. As with the previous embodiments, the fluid needle 243 may be withdrawn from the gun completely for cleaning, as the cap 215 has an internal flange (not shown) which picks up the end of the needle 243 adjacent the cap 215.

The piston 250 is operated by pressurised gas entering the piston housing 252 from a piston gas inlet 253. As with the atomising gas, the piston gas in controlled by a valve means remote from the gun itself. As the piston gas enters the piston housing 252, the gas pushes the piston 250 back and into contact with a flange 254 on the needle 243. Therefore, as the piston 250 moves back, the needle 243 also moves back, thus opening the fluid tip 245 to spray material located in the fluid tube 244 which has entered the fluid tube 244 via a fluid inlet 260. An abutment (not shown) on the inside of the cap 215 then comes into contact with the needle 243, thus restricting movement of the needle 243. Therefore, if the cap 215 is screwed clockwise onto the housing it will lessen the amount of movement possible by the needle, and if it is screwed anti-clockwise it will increase the amount of needle movement. Hence, fluid flow in the gun is controlled by the adjustment of the cap 215.

Figure 8A:
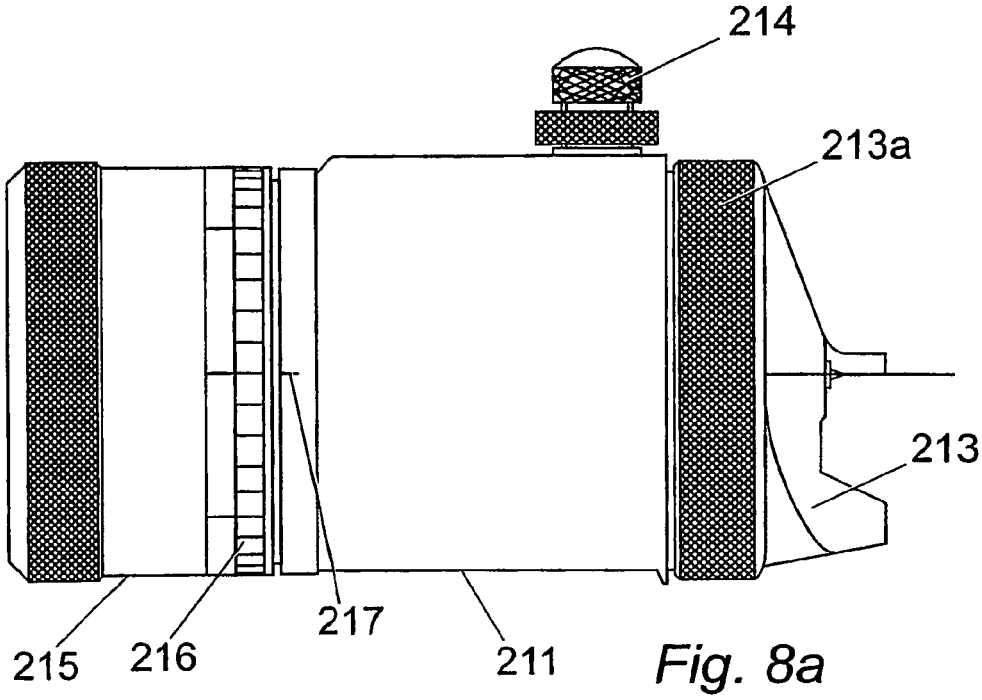
FIG. 8(*a*) shows a side elevation of a fifth embodiment of the spray apparatus.
Figure 8B:
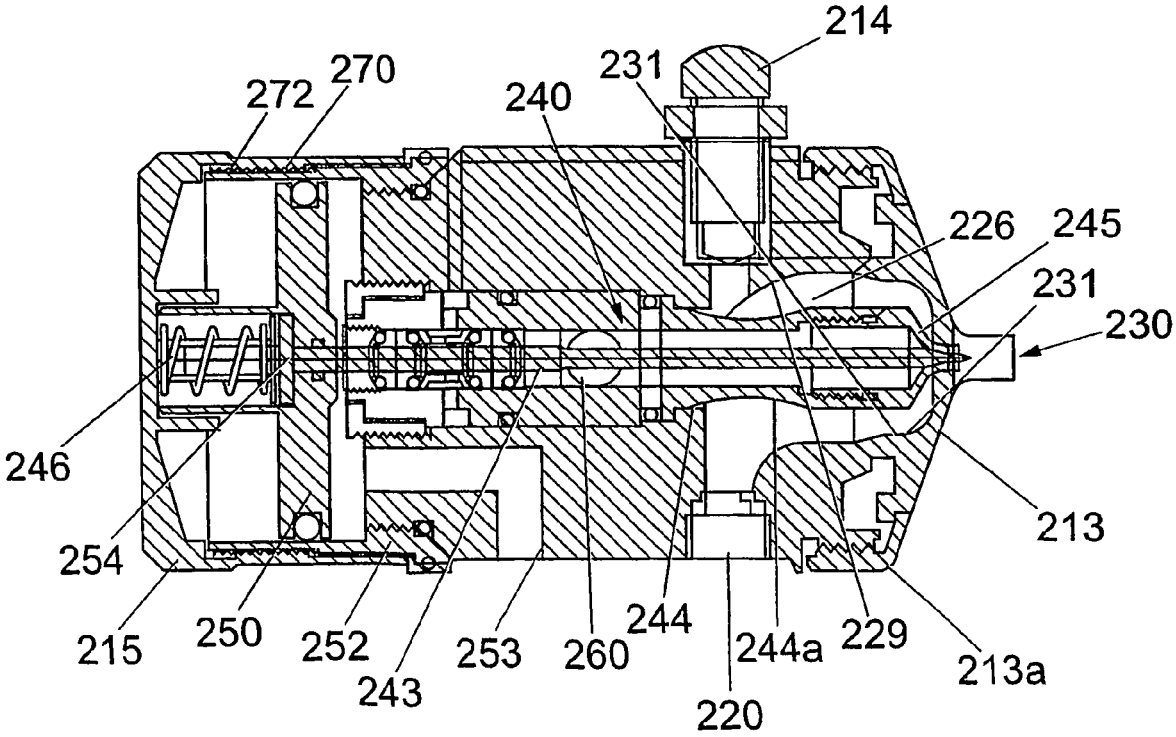

FIG. 7 shows a cross-section of the embodiment of FIGS. 5 and 6, but along section line VII—VII. The main purpose of this cross-section is to illustrate the lateral taper of the output chamber 226, which can be included in any of the previously described embodiments. As can be seen in FIG. 7, the inner surface 270 of the chamber 226 tapers laterally outwardly from inlet to outlet. This taper again aids the smooth flow of gas through the gun FIGS. 8(*a*) and (*b*) show a fifth embodiment of the spray apparatus, which is an adaptation of the fourth embodiment of the apparatus. The fifth embodiment shares the majority of the features of the fourth embodiment and these will not be described further here, but are shown with the same reference numerals in FIGS. 8(*a*) and (*b*). Where the fifth and fourth embodiments differ is that the end cap 215 in the fifth embodiment has been adapted so as to provide fine adjustment of the movement of the needle valve 243. The only differences visible from outside the apparatus, as shown in FIG. 8(*a*), are that the end cap 215 now fits over the end of the piston housing 252 and is provided with calibrations 216. The calibrations 216 are viewed against a reference line 217 on the piston housing 252.

FIG. 8(*b*) shows the adaptations to the end cap 215 in more detail. It can be seen that the end cap 215 has internal threads 270 which co-operate with external threads 272 on the outside of the piston housing 252. With the calibrations 216 on the end cap 215, the operator can easily adjust the permitted movement of the needle 243 to obtain a previous setting. Thus, there is no longer a need for the lock nut of the previous embodiment. Otherwise, the fifth embodiment operates in the same way as the fourth embodiment.

An advantage of the present invention over existing spray apparatus is that pressure loss across the gun from gas inlet to the nozzle is reduced thanks to the efficient flow of gas through the gun. In the manual embodiment, the gas passageway is substantially straight and the control valve bore is the same size as that of the passageway so that the flow of gas is uninhibited when the control valve is open. In both the manual and automatic embodiments the inlet to the output chamber has an increased diameter to allow a gradual curve of the gas flow into a substantially horizontal direction through the chamber. Furthermore, with the lateral taper of the chamber wall and the inward taper adjacent the output nozzle, gas flow through the chamber is smooth. The gas flow is further aided as the diameter of the fluid tip of the needle valve does not protrude outwith the diameter of the fluid tube and the fluid tube has a tapered throat section in the output chamber.

A further advantage of the present invention is that by providing the cap markings and indicator lines on the gun housing, the operator of the gun may adjust the spray of the gun to an exact setting previously used. This repeatability means that there no longer a need for the operator to waste valuable time experimenting to retrieve a previously used spray ratio.

A possible modification to the present invention would be to incorporate a radioactive ionising source such as a radioactive ionising cartridge, for example, into the atomising gas inlet. Introducing such a source would ionise the atomising gas and would overcome problems associated with static charge build up on atomised spray droplets.

This and other modifications and improvements can be incorporated without departing from the scope of the invention.

The invention claimed is:

1. An apparatus for spraying liquid surface treatment material, the apparatus comprising:

a body;

a liquid inlet for supply of the liquid surface treatment material;

a gas inlet for supply of pressurized gas to be mixed with the liquid surface treatment material;

an outlet nozzle through which the gas and liquid surface treatment is sprayed;

a control needle valve adapted to regulate the supply of the liquid surface treatment material to the outlet nozzle;

a gas supply passageway adapted to supply gas from the gas inlet to the outlet nozzle; and a control means for controlling the control needle valve, the control means comprising a cap member received on the body and engaged with the control needle valve, the cap member being adapted so as to be adjustable in the axial direction relative to the body to limit axial movement of the control needle valve;

wherein the cap member and body are each provided with a plurality of indicators which indicate the limit applied to the axial movement of the control needle valve, and wherein the apparatus is adapted such that the control means does not restrict gas flow in the gas supply passageway when limiting the axial movement of the control needle valve.

2. The apparatus of claim 1, further comprising a gas valve operable between an open position and a closed position.

3. The apparatus of claim 2, wherein the gas valve is located in the gas supply passageway.

4. The apparatus of claim 2, further comprising a trigger means adapted to operate both said control needle valve and gas valve.

5. The apparatus of claim 1, wherein the control needle valve comprises a fluid needle located in a needle housing, the needle and needle housing adapted to selectively move in an axial direction relative to the body, and wherein the needle is arranged such that a gap exists between the end of the needle and the end of the needle housing when the control means is adjusted so as to prevent any axial movement of the control needle valve.

* * * * *